United States Patent [19]

van der Zee

[11] 4,188,972

[45] Feb. 19, 1980

[54] GAS VALVE ASSEMBLY

[75] Inventor: Jan H. van der Zee, Emmen, Netherlands

[73] Assignee: Honeywell Inc., Minneapolis, Minn.

[21] Appl. No.: 938,617

[22] Filed: Aug. 31, 1978

[51] Int. Cl.[2] ..... F23N 1/00

[52] U.S. Cl. ..... 137/489; 137/495; 251/30

[58] Field of Search ..... 137/489, 488, 495, 492, 137/492.5; 251/30

[56] References Cited

U.S. PATENT DOCUMENTS

| | | | |
|---|---|---|---|
| 3,477,462 | 11/1969 | Ray | 137/489 |
| 3,552,430 | 1/1971 | Love | 137/495 |
| 3,559,884 | 2/1971 | Visos | 137/489 X |
| 3,721,263 | 3/1973 | Visos | 137/495 |

FOREIGN PATENT DOCUMENTS

| | | |
|---|---|---|
| 2358845 | 6/1975 | Fed. Rep. of Germany . |
| 195454 | 1/1938 | Switzerland . |

*Primary Examiner*—Alan Cohan

*Attorney, Agent, or Firm*—Clyde C. Blinn

[57] ABSTRACT

A gas valve assembly has a main valve connected between the inlet and outlet and controlled by a diaphragm actuator. A two position control valve connects the upper side of the diaphragm to either the inlet gas pressure or the outlet gas pressure to open or close the main valve. A pressure responsive valve means responding to the outlet pressures, controls the exhausting of gas from the upper side of the diaphragm to regulate the outlet pressure. An orifice is contained in the inlet passage to the control valve so that when the control valve is in an on position, the flow of gas to the upper side of the diaphragm is restricted by the orifice. To insure an initial fast opening of the main valve to insure ignition of the combustion device, a flow control valve means is placed in series with the orifice to increase the flow rate of gas when the control valve is moved from the off to the on position to fill the chamber above the diaphragm quickly. The flow control valve closes as soon as the pressure builds up on the upper side of the diaphragm; however, the delay in the operation of the flow control valve provides for an initial fast opening of the valve means when the control valve is operated.

9 Claims, 2 Drawing Figures

GAS VALVE ASSEMBLY

BACKGROUND OF THE INVENTION

Field of the Invention: Gas valve assemblies having diaphragm actuators with pressure regulators for maintaining the outlet pressure at some predetermined value have continually been faced with the problem of a compromise between good control and fast operation on an initial opening of the valve to have sufficient gas flow for ignition. In order to be able to use a main valve with a small stroke for control as sensitive as possible, the servo feed orifice should be small in order that the gas supply to one side of the diaphragm remains small and the venting from the other side of the diaphragm is possible with small movement of the servo valve. On the other hand, there is a requirement that the outlet gas pressure be sufficient for ignition of the burner and must be established within predetermined limits of time, for example, within two or three seconds, which means a sufficient pressure for actuating the main valve means must be reached on one side of the diaphragm in this time interval. The diaphragm chamber comprises a certain volume by reason that the diaphragm diameter and the stroke necessary for actuating the main valve. This diameter need be large when the gas valve is of a certain security class and must overcome a strong spring acting upon the main valve. The requirement of a small feed orifice is a necessity and yet for the initial opening of the valve, such can be a fatal limitation.

SUMMARY OF THE INVENTION

The present invention is concerned with a gas valve assembly wherein a diaphragm actuator operated a main valve. The diaphragm actuator has a chamber to which gas flows from an inlet when a two position control valve opens. The gas flow is restricted by an orifice so that a servo or pressure regulator on the outlet of the diaphragm chamber can maintain the position of the main valve to maintain the outlet pressure at some predetermined value. In order to insure a fast opening of the valve to obtain sufficient gas for ignition, a flow controller means or valve is placed in a passage around the orifice to provide a greater flow of inlet gas to the upper side of the diaphragm on the initial operation of the control valve. As soon as the gas pressure on the upper side of the diaphragm has reached some predetermined value, the flow controller means closes to place the gas valve assembly under the normal control where the inlet is through the orifice.

BRIEF DESCRIPTION OF THE PREFERRED EMBODIMENT

Figure 1:
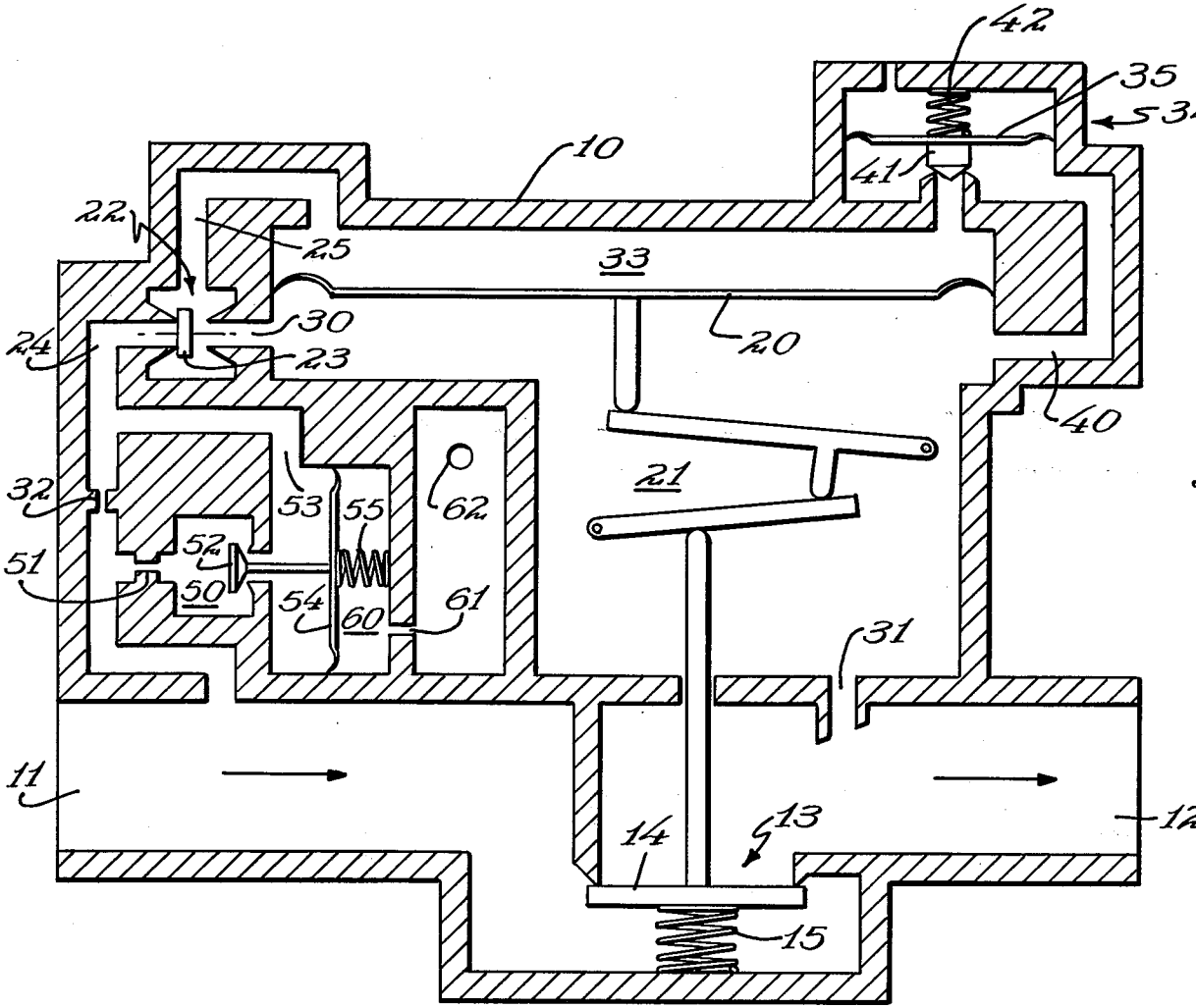
FIG. 1 is a diagrammatic sectional view of the gas valve assembly showing the control valve means with the orifice and flow control valve.

Referring to FIG. 1, the gas valve assembly has a body or housing 10 with an inlet opening 11 and an outlet opening 12. The inlet opening is adapted to be connected to a source of gas under pressure and the outlet opening is adapted to be connected to a gas combustion device or furnace. The main valve 13 has a valve member 14 which is biased to a closed position by a spring 15 and can be opened when the gas pressure on the upper side of a diaphragm or pressure responsive actuator means 20 increases to move the diaphragm downward to operate a linkage 21 comprising a double lever system for a mechanical advantage. A control valve 22 has a valve member 23 which can be moved in one of two positions by a conventional actuator (not shown). Valve member 23 is in the first or off position to block the passage of gas from a channel or conduit 24 and in that position, a channel 25 is connected to the exhaust channel 30 which is connected to outlet opening 12 through a channel 31. When control valve member 23 is moved to the second or on position, channel 24 is connected to channel 25 and channel 30 is closed. Channel 24 is then connected through a flow control means or orifice 32 to the inlet opening 11 for providing a supply of gas under pressure through the control valve 22 to the chamber 33 above the diaphragm 20.

A pressure regulator 34 has a diaphragm or valve actuator member 35 responsive to the outlet pressure through channel 40. When the outlet pressure reaches a predetermined value, valve member 41 is opened to exhaust the gas from chamber 33 and move valve member 14 in a closed direction to regulate the pressure at a value depending upon the size of the spring 42. With no outlet pressure, valve 41 is closed.

Whenever control valve means 22 is opened, the gas flows from the high pressure inlet 11 through the orifice 32 into chamber 30 to open main valve 13. The pressure at the outlet opening 12 is maintained by the exhausting of gas from the chamber 33 through the regulator 34 at a rate greater than can be supplied by the orifice 32. Thus by the size of the orifice 32 and the size of the opening of valve 41, the sensitivity of the regulator 34 can be maintained to keep the outlet pressure 12 within predetermined limits.

Upon the initial operation of control valve 22, there is a need for a fast operation of the main valve 13 to insure that a sufficient amount of gas is delivered to the combustion device to insure ignition. A bypass or flow control means 50 is provided around the orifice 32 which has a greater flow capacity. The bypass 50 comprises an orifice 51, a valve 52 and a channel 53. Valve 52 is controlled by a diaphragm or actuator 54 which is spring biased by a spring 55 in a valve open position and has pressure on its right side in chamber 60 as atmospheric air pressure through channel 61 and 62 which are connected to the outside of the valve body 10.

When control valve 22 opens, the gas pressure in channels 24 and 53 will become almost equal with the pressure in chamber 33. As at that moment the pressure in chamber 33 is equal with the atmospheric pressure, spring 55 will open valve 52, gas flows through orifice 32 and through the bypass 50 to build up the pressure quickly on the upper side of diaphragm 20 in chamber 33. As soon as the pressure in chamber 33 is such that the force of spring 55 will be overcome by the force of the diaphragm, valve 52 will close. The setting of spring 55 is such this will be always before the final outlet pressure is reached. Main valve 13 is opened and sufficient gas is provided for ignition. This closure of bypass 50 will provide that normal operation of the valve then continues by a supply of gas to chamber 33 through the orifice 32.

DESCRIPTION OF THE SECOND EMBODIMENT

Figure 2:
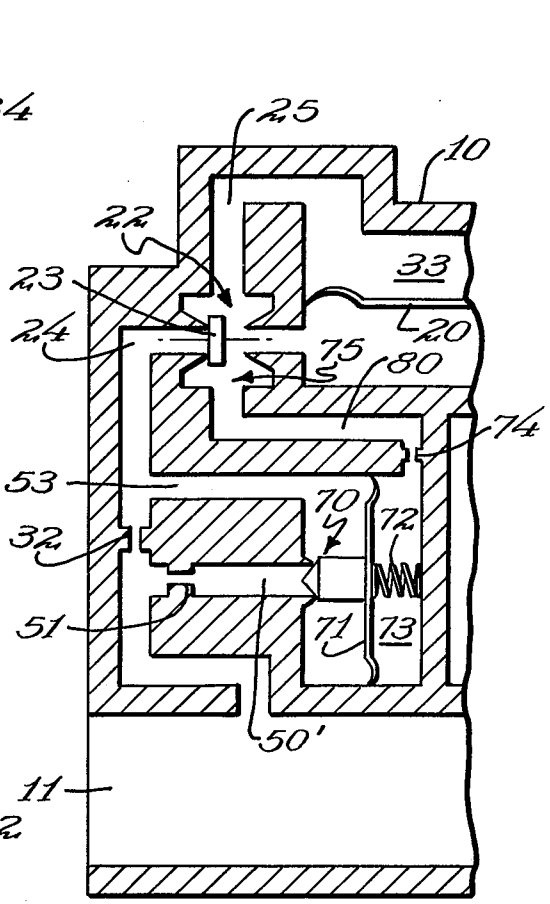
FIG. 2 is a diagrammatic sectional view of a second embodiment of the invention.

The gas valve assembly as shown in FIG. 2 is substantially the same as FIG. 1, except the bypass or flow control means 50′ is changed, thus the valve assembly is only partially shown. The remaining portion is the same as FIG. 1. Gas is supplied from the inlet opening 11 through the orifice 32 to control valve 22 in the manner as described in connection with the embodiment of FIG. 1 to operate the actuator or diaphragm 20 by controlling the gas pressure in chamber 33. The bypass 50′ has the orifice 51 and a valve 70 which is controlled by a diaphragm 71 spring biased by a spring 72 in a valve closing direction. The left side of diaphragm 72 receives gas through orifice 51 to flow into channel 53. The right side of diaphragm 70 has a chamber 73 which is connected through an orifice 74 to the chamber 75 of the control valve which is connected to channel 25 or the chamber 33 of the diaphragm actuator.

When the control valve is opened, i.e. the member 23 moves to the right, gas from the inlet flows through orifice 32 and the bypass 50′ through the open valve 70 into the chamber 33 to quickly build up the pressure in chamber 33. As the pressure of the gas in chamber 33 increases, the pressure in channel 80 increases and gas flow through the orifice 74 gradually increases the pressure in chamber 73 which brings about the gradual closing of valve 70 to cut off the bypass 50′. By means of the size of orifice 74, the timing can be sufficient to insure that the valve 13 is opened fast to insure that sufficient gas is delivered to the combustion device for ignition and yet once the pressure in chamber 33 builds up to open the valve wide open, the flow of gas to chamber 33 is restricted for normal operation through the orifice 32 as the bypass 50′ will be closed.

The embodiments of the invention in which an exclusive property or right is claimed are defined as follows:

1. A gas valve assembly comprising, a main valve means connected between an inlet opening and an outlet opening adapted to be connected to provide the flow of gas from a source to a gas combustion device, a main valve actuator means connected to said main valve means having a pressure response means to which gas flows to open said main valve means, control valve means, flow control means connecting an inlet of said control valve means to said inlet opening, channel means connecting an outlet of said control valve means connected to said pressure responsive means whereby the gas pressure in said pressure responsive means is increased to open said main valve means when said control valve means is opened, said flow control means comprising means to provide high rate of gas flow from said inlet opening when the pressure to said inlet of said control valve means is low and a low rate of gas flow from said inlet opening during normal operation when the pressure to said inlet of said control valve means is high thereby providing for fast operation of said main valve means when said control valve means is initially opened to insure that the initial flow of gas to the gas combustion device is sufficient for ignition.

2. The invention of claim 1 wherein said flow control means comprising a first orifice connected between said inlet opening and said inlet of said control valve means to provide said low rate of gas flow, and pressure operated valve means connected in parallel with said orifice and responding to inlet pressure to said inlet of said control valve to open said pressure operated valve means at a low pressure and close said pressure operated valve means when said inlet pressure increases to normal operating pressure.

3. The invention of claim 2 comprising, a second orifice larger than said first orifice said second orifice being connected in series with said pressure operated valve means.

4. The invention of claim 1 wherein, said pressure responsive means is a diaphragm having a chamber on one side in which a build up of pressure opens said main valve means.

5. The invention of claim 4 comprising, pressure operated flow control valve means responsive to the pressure of said outlet opening, means connecting said pressure operated flow control valve means between said chamber and said outlet opening to control the exhausting of gas from said chamber and thus control said main valve means and maintain a selected outlet gas pressure to the combustion device, said flow control means providing for low gas flow to said chamber during normal operation whereby said pressure operated flow control means can exhaust gas from said chamber to maintain said selected outlet gas pressure.

6. The invention of claim 2 wherein said pressure operated valve means comprises a member having gas pressure from said inlet of said control valve means on one side and open to the atmosphere on the other side, a spring means biasing said member against said gas pressure, valve means, and means connecting said member to a valve means so said spring biases said valve to an open position and as said inlet gas pressure to said control valve means increases, said valve means is moved toward a closed position.

7. The invention of claim 2 wherein said pressure operated valve means comprises, a member having gas pressure from said inlet of said control valve means on one side and gas pressure through a first passageway to said outlet opening on the other side, spring means biasing said member against said inlet gas pressure, valve means and means connecting said member to said valve means so said spring means biases said valve means closed, said control valve means comprises a two position valve to close said inlet in a first position and to open said inlet and close said passageway and connect said other side to said inlet in a second position, and an orifice in said first passageway whereby upon said control valve means moving to said second position, both sides of said member are connected to said inlet pressure, however, said orifice delays an increase in gas pressure on said other side of said member to keep said valve means open for a predetermined time.

8. In an improvement in a gas valve assembly having a main valve adapted for controlling the flow of gas from a source to a combustion device with the main valve having a pressure responsive actuator means to which gas flows through an orifice and a control valve means when the control valve means is operated and exhausts through a pressure regulator valve to maintain the pressure of gas to the combustion device at a predetermined value, the improvement comprising:

flow control means connected providing an additional gas flow to said actuator means for a predetermined period of time upon the initial operation of said control valve means to initially rapidly open said main valve means to provide sufficient gas to the combustion device for ignition.

9. The invention of claim 8 wherein, said flow control means is connected in series with said orifice to provide additional gas flow to said pressure responsive actuator means until the pressure of said actuator means is operating at normal gas pressure.

* * * * *